US005993131A

United States Patent [19]

Theurer et al.

[11] Patent Number: 5,993,131

[45] Date of Patent: Nov. 30, 1999

[54] BULK LOADER CAR

[75] Inventors: Josef Theurer, Vienna; Herbert Wörgötter, Gallneukirchen, both of Austria

[73] Assignee: Franz Plasser Bahn Baumaschinen-Industriegesellschaft M.B.H, Vienna, Austria

[21] Appl. No.: 09/074,295

[22] Filed: May 7, 1998

[30] Foreign Application Priority Data

May 14, 1997 [AT] Austria ..... 825/97

[51] Int. Cl.[6] ..... B65G 67/00

[52] U.S. Cl. ..... 414/339; 104/2; 105/335; 414/505; 414/523

[58] Field of Search ..... 414/339, 502, 414/505, 528, 523; 104/2; 105/355

[56] References Cited

U.S. PATENT DOCUMENTS

| | | | |
|---|---|---|---|
| 2,724,515 | 11/1955 | Scheuchzer et al. | 414/339 |
| 4,204,496 | 5/1980 | Cicin-Sain | 104/2 |
| 5,219,262 | 6/1993 | Theuzez et al. | 414/505 |
| 5,221,172 | 6/1993 | Theurer et al. | 414/339 |
| 5,341,746 | 8/1994 | Theurer et al. | 414/339 X |
| 5,364,221 | 11/1994 | Theurer et al. | 414/339 |
| 5,400,718 | 3/1995 | Theurer et al. | 104/2 X |

FOREIGN PATENT DOCUMENTS 3147018 7/1982 Germany .

*Primary Examiner*—David A. Bucci
*Attorney, Agent, or Firm*—Horst M. Kasper

[57] ABSTRACT

A bulk loader car (1) comprises a storage box (2) exhibiting a ground conveyor belt (4) and a support frame (3). The storage box (2) is supported on a vehicle undercarriage frame (9), wherein in each case rail undercarriages (12) are disposed on end sides of the vehicle undercarriage frame (9). A transfer conveyor belt (8) is coordinated to a discharge end (6) of the ground conveyor belt (4) disposed at an angle to the horizontal. The vehicle undercarriage frame (9) is composed out of a first and a second car frame (10, 11) connected to each other by a coupler (15). The storage box (2) is supported in each case by a swivel ring (19, 20) on the two car frames (10, 11). One of the swivel rings (19) is supported longitudinally shiftable relative to the car frame (10).

11 Claims, 1 Drawing Sheet

BULK LOADER CAR

BACKGROUND OF THE INVENTION

1. Field of the Invention

The invention relates to a bulk loader car with a storage box exhibiting a ground conveyor belt and a support frame, wherein the storage box is supported by an undercarriage frame with in each case rail undercarriages disposed at the end side, wherein a transfer conveyor belt is coordinated to a discharge end of the ground conveyor belt disposed at an angle relative to the horizontal.

2. Brief Description of the Background of the Invention Including Prior Art

Such bulk loader cars have already become known from different publications. For example, the U.S. Pat. No. 5,219,262 describes a loader car with an elongated flat vehicle undercarriage frame, which can be moved on a rail track by means of rail undercarriages disposed at the ends of the flat vehicle undercarriage frame. A storage box, exhibiting a support frame, is mounted by way of supports on the undercarriage frame and contains a ground conveyor belt, running in the longitudinal direction of the car. A transfer conveyor belt follows to the discharge end of the ground conveyor belt. The transfer conveyor belt collars at an angle relative to the horizontal position and inclined upwardly beyond an end of the vehicle undercarriage frame. Upon coupling together of several such cars, the ground conveyor belts and the transfer conveyor belts, overlapping each other at their ends, form a continuous conveyor-belt road for the through transport of bulky material along the complete train set formation, or selectively for filling the individual storage boxes. The storage capacity of these loader cars depends, amongst other things, on the permissible axle loads.

Furthermore, a loader car is known from the German printed patent document DE 31 47 018 A1, wherein the loader car is employed for the transport of ore in mining. This loader car, shown in FIG. 7 of the German printed patent document DE 31 47 018 A1, is a loader car with an elongated storage box having a high storage capacity. The storage box is fixedly attached to a support frame and is supported together with the support frame on an undercarriage frame. In order to improve the curve-negotiating behavior in underground work operations or in mining, the undercarriage frame is composed of two frame parts. Two frame parts are disposed in series in the longitudinal direction of the track and are connected to each other by way of a hinged coupler. The free ends of the frame parts, are spaced apart from each other, and are in each case supported on a rail undercarriage. A so-called intermediate vehicle is furnished with a further undercarriage in the region of the coupler, and the two frame parts rest on the intermediate vehicle. The support frame of the storage box is supported on the undercarriage frame, in each case in the region of the end-side rail undercarriages with a hinged support, whereby the load of the storage box together with the bulk material stored therein applied in its totality onto these undercarriages at the end side, whereas the center undercarriage serves only for controlling the undercarriage frame in curved sections of the track.

SUMMARY OF THE INVENTION

1. Purposes of the Invention

It is an object of the present invention to furnish a loader car of the recited kind, wherein an exceeding of the highest permissible axle loads can be avoided even in the case of an increased load capacity.

These and other objects and advantages of the present invention will become evident from the description which follows.

2. Brief Description of the Invention

According to the present invention there is provided for a bulk loader car comprising a first and a second car frame. First rail undercarriages are disposed below the first car frame and at two ends of the first car frame. Second rail undercarriages are disposed below the second car frame and at two ends of the second car frame. A coupler connects the first car frame to the second car frame and composes thereby a vehicle undercarriage frame. A first swivel ring is disposed on the first car frame. A second swivel ring is disposed on the second car frame. The second swivel ring is supported longitudinally shiftable relative to the second car frame. A support frame is supported by the first swivel ring and by the second swivel ring. A storage box is built on the support frame. A ground conveyor belt is disposed in the storage box and has a discharge end. A transfer conveyor belt is coordinated to the discharge end of the ground conveyor belt and is disposed at an angle to a horizontal plane.

The first car frame and the second car frame can each be formed as a flat car conforming to the type of a standard vehicle.

The first rail undercarriages and the second rail undercarriages can each be formed as bogies with pivot pins.

The first swivel ring, supporting the support frame on the first car frame, can be furnished in a region between the first rail undercarriages coordinated to the first car frame or, respectively, the respective pivot pins, in the transverse middle of the first car frame. The second swivel ring, supporting the support frame on the second car frame, can be furnished in a region between the second rail undercarriages coordinated to the second car frame or, respectively, the respective pivot pins, in the transverse middle of the second car frame.

The second longitudinally-shiftably supported swivel ring can be movable relative to the second car frame and can be disposed on a slider.

A number of rollers, rollable on the second car frame, can be disposed on the slider. Rotation axes of the rollers can be directed transverse to a forward direction of the second car frame. The slider can be supported by the rollers.

A roller track can be disposed on the slider. A number of rollers, runnable on the roller track, can be disposed on the slider. Rotation axes of the rollers can be directed transverse to a forward direction of the second car frame. The slider can be supported by the rollers.

A protective device for preventing an overturning of the vehicle can be disposed between the slider and the second car frame, and can be movably connecting the slider to the second car frame.

Springing support members can be furnished between the support frame and the first car frame. The support members can be connected to the support frame and the first car frame and can be disposed at a distance from each other transverse to an advance direction of the first car frame.

The support members can be furnished in a region between the first swivel ring and the second swivel ring and can be formed as flexible helical spring couplings. The flexible helical spring couplings can be adjustable in a direction transverse to the first car frame relative to one of the support frame and of the car frame.

A bulk loader car comprises a storage box. A ground conveyor belt is disposed in the storage box and has a discharge end. A first car frame is coupled to a second car frame. A first swivel ring is supported on the first car frame and supports the storage box. A longitudinally shiftable second swivel ring is supported on the second car frame and supports the storage box. A transfer conveyor belt is disposed on the second car at an angle to the horizontal and coordinated to the discharge end of the ground conveyor belt.

This object is attained with a loader car of the kind recited by having the vehicle undercarriage frame made of a first car frame and a second car frame, connected by way of a coupler to each other. The storage box is supported in each case by a swivel ring or bogie on the first and second frames. One of the swivel rings is supported longitudinally shiftable relative to the car frame.

Such an arrangement of the vehicle undercarriage frame composed of two car frames in connection with the support of the storage box according to the invention allows in a most simple way to form the storage box with a relatively large length for the advantageous increase of the loading volume without any problems. By employing two car frames, exhibiting on the end sides in each case rail undercarriages, the total weight of the loader car can be subdivided in overall four rail undercarriages. This assures that the axial loads or, respectively, the wheel set loads, exerted onto the track by the individual axles, remain reliably within the permissible highest limits fixed by the railroad administration. Based thereon, the loading volume of the storage box cannot only be increased substantially, but in addition an excessive or non-uniform wear of the rail undercarriages is prevented. The curve-negotiating capabilities of the bulk loader car are fully supported and enhanced and/or are enabled without limitations by the two swivel rings and in particular by the longitudinally shiftable construction of one of the swivel rings.

According to a specific embodiment, the advantageous possibility exists to produce the loader car according to the invention by using already available flat cars in a most economic way, wherein these flat cars are constructively, and in a relatively simple way, retrofitted within the concept of the present invention.

According to a further preferred embodiment of the invention, there is a still more favorable track and material protecting and preserving subdivision of the vehicle weight onto a total of eight wheel axles.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
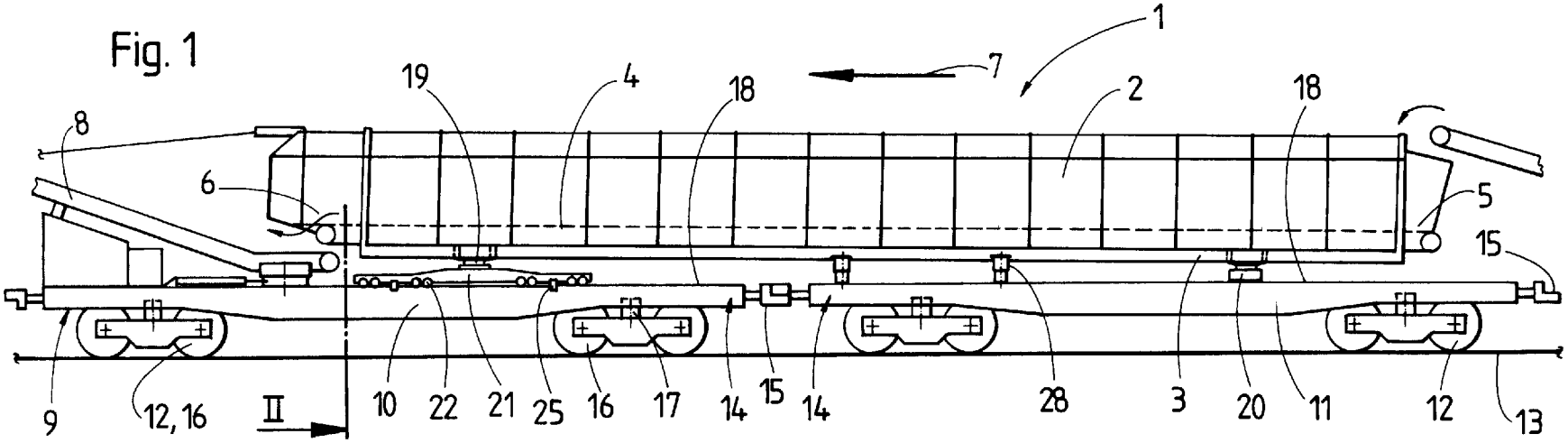
FIG. 1 is a side elevational view of a bulk loader car.

The present invention provides for a bulk loader car 1 with a storage box 2 exhibiting a ground conveyor belt 4 and a support frame 3. The storage box 2 is supported on a vehicle undercarriage frame 9. In each case rail undercarriages 12 are disposed on end sides of the vehicle undercarriage frame 9. A transfer conveyor belt 8 is coordinated to a discharge end 6 of the ground conveyor belt 4 disposed at an angle to the horizontal. The vehicle undercarriage frame 9 is composed out of a first and a second car frame 10, 11 connected to each other by a coupler 15. The storage box 2 is supported in each case by a swivel ring 19, 20 on the two car frames 10, 11. One of the swivel rings 19 is supported longitudinally shiftable relative to the car frame 10.

The car frames 10, 11 can in each case be formed as a flat car 14 conforming to the type of a standard vehicle.

The rail undercarriages 12 can be formed as bogies 16 with pivot pins 17.

The swivel rings 19, 20 of the support frame 3 on the two car frames 10, 11 can be furnished in each case in the region between the two rail undercarriages 12, coordinated to the respective car frame 10, 11, or, respectively, the respective pivot pins 17, in the transverse middle of the car.

The longitudinally-shiftably supported swivel ring 19 can be disposed on a slider 21, movable relative to the car frame 10.

The slider 21 can exhibit a number of rollers 22 disposed on the car frame 10 or, respectively, rollable on a roller track 24, disposed on the slider 21, with rotation axes 23 of the rollers running in the cross direction of the car.

A protective device 25 for preventing an overturning of the vehicle can be disposed between the slider 21 and the car frame 10, and can movably connect the slider 21 to the car frame 10.

Springing support members 28 can be furnished between the support frame 3 and the car frame 11. The support members 28 can be connected to the support frame 3 and the car frame 11 and can be disposed at a distance from each other in the cross direction of the car.

The support members 28, furnished in the region between the two swivel rings 19, 20, can be formed as flexible helical spring couplings 29, adjustable in a direction transverse to the car relative to one of the support frame 3 and of the car frame 11.

Figure 2:
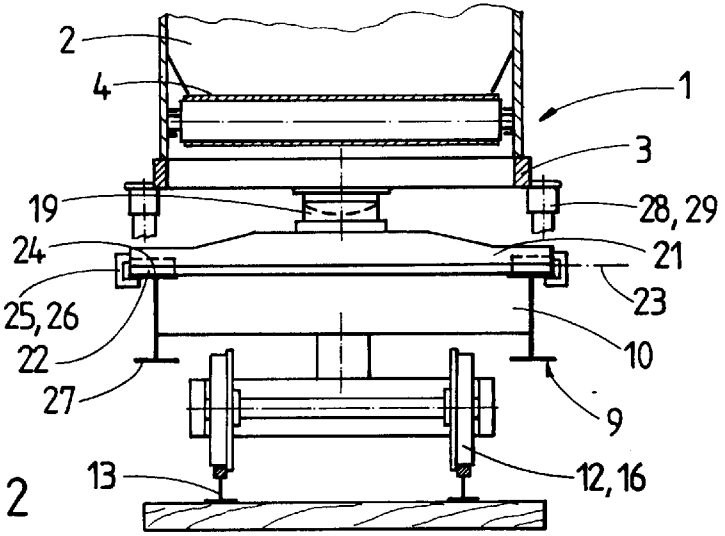
FIG. 2 is a cross-sectional view, according to arrow II of FIG. 1.

A bulk loader car 1, illustrated in FIGS. 1 and 2, exhibits an elongated, upwardly open storage box 2. The storage box 2 can be of substantially rectangular shape as seen in a vertical projection. Upright walls of the storage box 2 can be disposed vertically extending from a substantially rectangular base. The storage box 2 is built on a support frame 3 and is furnished with a ground conveyor belt 4, forming a floor of the storage box 2, and extending over substantially the full length of the storage box 2. The transport direction of the ground conveyor belt 4, exhibiting a receiving end 5 and a discharge end 6, is indicated by an arrow 7. Baffles can be provided inside the storage box 2 and adjacent to the ground conveyor belt 4 for preventing that bulk material falls below the ground conveyor belt in the storage box. The conveyor belt can have a width substantially corresponding to the width of the bottom of the storage box 2. The discharge end 6 of the storage box 2 can exhibit an inclined or curved section between the bottom and front side of the storage box 2 with an opening for discharging material from the storage box 2. The discharge end 6 is coordinated to a transfer conveyor belt 8 leading upwardly at an inclined slope and disposed at an angle relative to the horizontal. The transfer conveyor belt 8 is disposed such that the charging end of the transfer conveyor belt 8 is disposed immediately below the discharge end 6 of the storage box 2.

The angle between the inclined slope of the transfer conveyor belt 8 and a horizontal line can be from about 20 to 50 degrees and is preferably from about 25 to 40 degrees. The ground conveyor belt 4 can be at an inclined slope relative to a horizontal line of from about 0.1 to 5 degrees and preferably of from about 0.5 to 2 degrees. The inclination of the transfer conveyor belt 8 and of the ground conveyor belt 4 are preferably aligned in their relative direction to a horizontal. The upper end of the transfer conveyor belt 8 and the lower end of the ground conveyor belt 4 are disposed in the direction of forward transport and the lower end of the transfer conveyor belt 8 and the lower end of the ground conveyor belt 4 are disposed in the rear relative to the direction of forward transport.

The storage box 2 is supported with the support frame 3 on a vehicle undercarriage frame 9. The vehicle undercarriage frame 9 is composed out of a first car frame 10 and a second car frame 11, and is movable based on rail undercarriages 12 running on a track 13. A car frame in the sense of the present invention is a vehicle with such undercarriages as to be suitable to be moved individually on rails. The length of the storage box 2 is larger than the length of a car frame 10, 11, and shorter than the combined length of two of the car frames 10, 11. The combined length of the storage box 2 and of the transfer conveyor belt amounts to substantially the length of two of the car frames. The length of the transfer conveyor belt is shorter than the length of one car frame. The horizontal length of the storage box 2 can be from about 1.4 to 1.9 times the length of the car frame and is preferably from about 1.6 to 1.7 times the length of the car frame. The horizontal length of the transfer conveyor belt can be from about 0.4 to 0.9 times the length of a car frame and is preferably from about 0.55 to 0.7 times the length of a car frame. The ground conveyor belt and the transfer conveyor belt are disposed such that another like system of ground conveyor belt and transfer conveyor belt can be serially joined at either end of the system ground conveyor belt and transfer conveyor belt to extend the transport range. The transfer conveyor belt can be furnished with a swivel axis disposed below the discharge end of the ground conveyor belt for allowing discharging material not only over the tracks, but additionally to the side of the tracks.

The two car frames 10, 11, are disposed immediately in series in the longitudinal direction of the track, and are formed as flat cars 14 based on a standard vehicle type. The two car frames 10, 11, are furnished on the end side in each case with a coupler 15 or, respectively, are connected to each other with this coupler 15 to form a unit. The coupler 15 is preferably furnished such as to maintain a substantially constant distance between the car frames 10 and 11. Each car frame 10, 11 exhibits at its end sides two rail undercarriages 12 in the shape of a bogie 16 with pivot pins 17. Each car frame 10, 11 furnishes a plane horizontal loading platform 18.

Two swivel rings 19 or, respectively, 20, disposed at a distance from each other in the longitudinal direction of the bulk loader car, serve for the support of the support frame 3 on the two car frames 10 and 11 of the vehicle undercarriage frame 9. The swivel rings 19 or, respectively, 20 are in each case disposed in the region between the two pivot pins 17 of the rotary bogie 16 of the respective car frame 10, 11 in the transverse middle of the bulk loader car 1 or, respectively, of the support frame 3. The rear swivel ring 20 relative to the transport direction (arrow 7) is in this situation fixedly connected to the loading platform 18 of the rear, second car frame 11, whereas the front swivel ring 19 is formed longitudinally shiftable relative to the front, first car frame 10. Preferably, for this purpose, the swivel ring 19 is mounted centered on a flat-formed slider 21. The flat-formed slider 21 is mounted to the loading platform 18 of the car frame 10. The width of the slider 21 corresponds approximately to the width of the loading platform 18. The slider 21 exhibits a number of rollers 22 with rotation axes 23, disposed transverse to the longitudinal direction of the bulk loader car, wherein the rollers 22 rest on the loading platform 18 and can roll on the loading platform 18 in the longitudinal direction of the bulk loader car. The rollers 22 are preferably disposed near the side edge of the loading platform 18 and substantially symmetrical to the position of the swivel ring 19 for providing stability to the swivel ring 19. For improving the rolling process, a roller track 24 can also be mounted on the loading platform 18. The roller track 24 extends in the region behind the transfer conveyor belt 8 in the longitudinal direction of the loader car 1. The transfer conveyor belt 8 is also attached to the loading platform 18 of the first car frame 10.

A protective device 25 for preventing an overturning of the vehicle is disposed between the slider 21 and the first car frame 10, wherein the protective device 25 for preventing an overturning of the vehicle prevents a sideways lifting of the slider 21 from the loading platform 18. The protective device 25 for preventing an overturning of the vehicle comprises in the present case a clamp-shaped bow 26. The bow 26 is attached laterally at the slider 21 and, as can be seen in particular from FIG. 2, grips and surrounds the upper flange of an I-support beam 27, wherein the car frame 10 is formed from the I-support beam 27. Thus, the longitudinal shiftability of the slider 21 relative to the car frame 10 is maintained without limitations.

Furthermore, a plurality of support members 28 is furnished between the support frame 3 and the second car frame 11 (or, respectively, the loading platform 18 of the car frame 11). The plurality of support members 28 serves for the lateral stabilization of the storage box 2 and is positioned approximately in the longitudinal center of the support frame 3. These overall four support members 28, shown in FIGS. 1 and 2, are springingly disposed at a distance from each other in pairs in each case in a cross direction to the vehicle, and are formed as a flexible helical spring coupling 29. The position of the four support members 28 is preferably arranged such as to be located substantially within a middle third of the length of the storage box 2. The flexible helical spring coupling 29 allows a slight cross shifting of the support frame 3 relative to the vehicle undercarriage frame 9 or, respectively, to the car frame 11 upon a passage of curved tracks, wherein at the same time a continuous support in case of a motion of the storage box 2 relative to the vehicle undercarriage frame 9 is assured.

The described embodiment of the bulk loader car 1 is particularly suited for the equipping and retrofitting of already existing flat railroad cars. The necessary devices for the construction of a storage box and of a transfer conveyor belt can be mounted in a simple way and with low constructive expenditures onto said already existing flat railroad cars. The resulting loader cars can subsequently be coupled to a combined train without any problems, thereby forming a continuous conveyor belt road.

It will be understood that each of the elements described above, or two or more together, may also find a useful application in other types of bulk loader cars differing from the types described above.

While the invention has been illustrated and described as embodied in the context of a bulk loader car with a storage box, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bulk loader car comprising a first car frame;

first rail undercarriages disposed below the first car frame and at two ends of the first car frame;

a second car frame;

second rail undercarriages disposed below the second car frame and at two ends of the second car frame;

a coupler connecting the first car frame to the second car frame and composing thereby a vehicle undercarriage frame;

a first swivel ring disposed on the first car frame;

a second swivel ring disposed on the second car frame, wherein the second swivel ring is supported longitudinally shiftable relative to the second car frame;

a support frame supported by the first swivel ring and by the second swivel ring;

a storage box built on the support frame;

a ground conveyor belt disposed in the storage box and having a discharge end;

a transfer conveyor belt coordinated to the discharge end of the ground conveyor belt and disposed at an angle to a horizontal plane.

2. The bulk loader car according to claim 1, wherein the first car frame and the second car frame are each formed as a flat car conforming to the type of a standard vehicle.

3. The bulk loader car according to claim 1, wherein the first rail undercarriages and the second rail undercarriages are each formed as bogies with pivot pins.

4. The bulk loader car according to claim 3, wherein the first swivel ring, supporting the support frame on the first car frame, is furnished in a region between the first rail undercarriages coordinated to the first car frame or, respectively, the respective pivot pins, in the transverse middle of the first car frame, and wherein the second swivel ring, supporting the support frame on the second car frame, is furnished in a region between the second rail undercarriages coordinated to the second car frame or, respectively, the respective pivot pins, in the transverse middle of the second car frame.

5. The bulk loader car according to claim 1, further comprising a slider, wherein the second longitudinally-shiftably supported swivel ring is movable relative to the second car frame and is disposed on the slider.

6. The bulk loader car according to claim 5, further comprising a number of rollers rollable on the second car frame and disposed on the slider, wherein rotation axes of the rollers are directed transverse to a forward direction of the second car frame, and wherein the slider is supported by the rollers.

7. The bulk loader car according to claim 5, further comprising a roller track disposed on the slider;

a number of rollers runnable on the roller track and disposed on the slider, wherein rotation axes of the rollers are directed transverse to a forward direction of the second car frame, and wherein the slider is supported by the rollers.

8. The bulk loader car according to claim 5, further comprising a protective device for preventing an overturning of the vehicle disposed between the slider and the second car frame, and movably connecting the slider to the second car frame.

9. The bulk loader car according to claim 1, further comprising springing support members furnished between the support frame and the first car frame, wherein the support members are connected to the support frame and the first car frame and are disposed at a distance from each other transverse to an advance direction of the first car frame.

10. The bulk loader car according to claim 9, wherein the support members are furnished in a region between the first swivel ring and the second swivel ring and are formed as flexible helical spring couplings, wherein the flexible helical spring couplings are adjustable in a direction transverse to the first car frame relative to one of the support frame and of the car frame.

11. A bulk loader car, comprising a storage box;

a ground conveyor belt disposed in the storage box and having a discharge end;

a first car frame;

a second car frame coupled to the first car frame;

a first swivel ring supported on the first car frame and supporting the storage box;

a longitudinally shiftable second swivel ring supported on the second car frame and supporting the storage box;

a transfer conveyor belt disposed on the second car at an angle to the horizontal and coordinated to the discharge end of the ground conveyor belt.

* * * * *

UNITED STATES PATENT AND TRADEMARK OFFICE

CERTIFICATE OF CORRECTION

PATENT NO : 5,993,131

DATED : November 30, 1999

INVENTOR(S) : Josef Theurer and Herbert Wörgötter

It is certified that error appears in the above-identified patent and that said Letters Patent is hereby corrected as shown below:

On the title page, item [73] Assignee, lines 1-3:

delete "Bahn Baumaschinen-Industriegesellschaft M.B.H."

and insert --Bahnbaumaschinen-Industriegesellschaft M.B. H.--

Signed and Sealed this

Seventh Day of November, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,993,131
DATED : November 30, 1999
INVENTOR(S) : Josef Theurer and Herbert Wörgötter It is certified that error appears in the above-identified patent and that said Letters Patent is hereby corrected as shown below:

Title page, item [73] Assignee, lines 1-3: delete "Bahn Baumaschinen-Industriegesellschaft M.B.H." and insert -- Bahnbaumaschinen-Industriegesellschaft M. B.H.

Signed and Sealed this

Fourteenth Day of August, 2001

*Attest:*

Nicholas P. Godici

NICHOLAS P. GODICI
*Acting Director of the United States Patent and Trademark Office*

*Attesting Officer*